US007250240B2

(12) United States Patent
Tosaka et al.

(10) Patent No.: US 7,250,240 B2
(45) Date of Patent: Jul. 31, 2007

(54) TONER, DEVELOPER, CONTAINER CONTAINING TONER, PROCESS, CARTRIDGE, IMAGE FORMING APPARATUS AND PROCESS

(75) Inventors: Hachiroh Tosaka, Shizuoka (JP); Tomiaki Ito, Shizuoka (JP); Yuji Natori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 304 days.

(21) Appl. No.: 10/863,248

(22) Filed: Jun. 9, 2004

(65) Prior Publication Data

US 2005/0014081 A1 Jan. 20, 2005

(30) Foreign Application Priority Data

Jun. 12, 2003 (JP) ..... 2003-168172
Apr. 21, 2004 (JP) ..... 2004-126034

(51) Int. Cl.
*G03G 9/00* (2006.01)

(52) U.S. Cl. ..... 430/108.1; 430/110.1; 430/137.2; 399/252; 399/253

(58) Field of Classification Search ..... 430/108.1, 430/110.1, 137.2; 399/252, 253
See application file for complete search history.

(56) References Cited

FOREIGN PATENT DOCUMENTS

JP 2000-19775 1/2000

OTHER PUBLICATIONS

Translation of JP 2000-19775.*
U.S. Appl. No. 11/524,379, filed Sep. 21, 2006, Taniguchi et al.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

The toner according to the present invention may be produced from a toner raw composition which comprises a foaming agent, a binder resin and a colorant, wherein the colorant comprises a black metal compound, the foaming agent has a volume-average particle diameter of 2 μm to 50 μm, the toner raw composition turns into a porous mixture while the foaming agent expands at melting and kneading the toner raw composition, and the toner obtained through milling and classifying the porous mixture has a specific density of 1.0 g/cm$^3$ to 1.3 g/cm$^3$, wherein the specific density is determined as follows: 1 gram of toner is pressed at 400 kgf/cm$^2$ for five minutes in a discal cavity having a diameter of 20 mm, then the discal toner is removed; the discal toner volume (V) is calculated from the diameter and height, measured at 10 minutes after releasing the pressure on the discal toner, and the discal toner mass (W) is measured; then the specific density is determined from the following formula: Specific Density ($\rho_T$)=W/V.

18 Claims, 6 Drawing Sheets

TONER, DEVELOPER, CONTAINER CONTAINING TONER, PROCESS, CARTRIDGE, IMAGE FORMING APPARATUS AND PROCESS

BACKGROUND OF THE INVENTION

1. Field of the Invention

The present invention relates to a toner for developing electrostatic images in electrophotography, electrostatic recording, electrostatic printing and the like, a developer comprising the toner, a container containing the toner, a process cartridge using the toner, an image forming apparatus using the toner, and an image forming process using the toner.

2. Description of the Related Art

Carbon black, being utilized conventionally as a black pigment in electrophotography, is concerned about its carcinogenicity; therefore, development of a black pigment is demanded that does not cause a safety issue. As for black pigments other than carbon black, there exist magnetic materials for a magnetic toner; however, such magnetic materials are difficult to be utilized for a conventional non-magnetic toner due to its magnetic property, therefore, a black pigment of non-magnetic type is desired.

As for such a black pigment of non-magnetic type, there exist organic and inorganic pigments. Examples of the organic pigment include active carbon, Nigrosine pigment, aniline black pigment and the like. However, such pigments other than carbon black are not sufficiently available, since they exhibit poor coloring power and also decrease toner resistance due to their own low resistance. On the other hand, as for the inorganic black pigment, a polycrystalline particle pigment, having a mixed composition of $Fe_2TiO_5$ and $Fe_2O_3$—$FeTiO_3$ solid solution is proposed for example (see Japanese Patent No. 2,736,680). This proposed pigment does not cause a safety issue, and is proper in thermal resistance and processing ability. However, the proposed inorganic black pigment is inferior to carbon black in coloring power, therefore, the content of the pigment must be increased up to 40 to 60 wt % in order to maintain the coloring level to that of carbon black.

Further, in the case that a metal oxide pigment is employed as an inorganic black pigment, the specific gravity (absolute density) of pigment itself exhibits two to three times as large as carbon black; the toner containing the inorganic pigment at the content of 40 to 60% by mass exhibits the specific density (defined later) of 1.4 to 1.8 times as large as the toner based on the non-magnetic toner. Accordingly, in a non-magnetic process, such problems arise as premature carrier life due to rapid toner adhesion on carrier surfaces, abnormality on toner content sensors, erroneous detection on remaining amount in one-component toner, and premature life of developing rollers due to toner filming on the developing rollers.

Further, in the case that a metal oxide pigment is employed, a problem arises that the toner tends to be consumed at higher rate, since the adhered amount of toner is relatively high on the OPC (Organic Photo-conductor).

Further, a process for enhancing the coloring power and black level of non-magnetic pigment is proposed, in which a complex oxide of fine particles consisting of cobalt, manganese and iron oxides is employed, the specific surface area of the pigment is increased up to 50 to 100 $m^2/g$, thereby the primary particle size of the pigment is remarkably decreased (see Japanese Patent No. 2,997,206). In this process, the coloring power of the pigment itself may be enhanced, thereby the coloring power equivalent to carbon black may be attained at the content of 10 to 30% by mass. However, such a pigment is not sufficiently available, since the coagulation of the pigment is significant due to the decreased particle size, resulting in the deterioration of charging level due to the insufficient dispersion of the pigment.

Further, a process for improving pulverizability is proposed, in which a foaming agent is added to the toner raw material, then the foaming agent is expanded at the step of melting and kneading to produce a toner (see Japanese Patent Application Laid-Open No. 2000-19775). In this proposal, pores are included in the non-magnetic toner based on carbon black in 10 to 60% by volume. Consequently, the specific density of the toner comes to about 0.7 $g/cm^3$, when 5 parts by mass of carbon black is added to the raw material and when the pore content is 30% by volume; that is, the specific density of toner is excessively low. This results in a lower controllability of toner control sensors, and causes a problem that the controlling part of the apparatus in use must be adjusted with the supplement of the toner.

The object of the present invention is to provide a toner, in which the toner contains a black metal oxide as a colorant, and exhibits a specific density that is equivalent to the conventional toner that contains carbon black, thereby the toner does not impose the necessity to adjust the controllability of toner control sensors, and the supplement of the toner may be easily carried out on the apparatus in use. Also the object of the present invention is to provide a developer, a container, a process cartridge, an image forming apparatus, and an image forming process that utilize the toner respectively.

SUMMARY OF THE INVENTION

The toner according to the present invention may be produced from a toner raw composition which comprises a foaming agent, a binder resin and a colorant, wherein the colorant comprises a black metal compound, the foaming agent has a volume-average particle diameter of 2 μm to 50 μm, the toner raw composition turns into a porous mixture while the foaming agent expands at melting and kneading the toner raw composition, and the toner obtained through milling and classifying the porous mixture has a specific density of 1.0 $g/cm^3$ to 1.3 $g/cm^3$.

In the toner according to the present invention, the specific density of 1.0 $g/cm^3$ to 1.3 $g/cm^3$ may be attained by utilizing a foaming agent of a certain volume-average particle size as well as a harmless black metal oxide as colorant, mixing the foaming agent into a toner raw material, expanding the foaming agent at the melting and kneading step, milling and classifying the porous mixture; therefore the toner according to the present invention exhibits the equivalent specific density to the toner based on carbon black, the toner according to the present invention does not cause the necessity to adjust the controlling part of the apparatus in use with the supplement of the toner, and the toner according to the present invention may be utilized for forming images without the concerns for human body and environment.

The process for producing a toner according to the present invention comprises a melting and kneading step, in which a toner raw composition, which comprises a foaming agent, a binder resin and a colorant, is melted and kneaded, and the foaming agent is expanded to form a porous mixture, and a milling and classifying step, in which the resultant porous mixture is milled and classified.

The developer according to the present invention comprises the toner according to the present invention. Accordingly, the developer may be utilized for forming images by means of electrophotography without the concerns for human body and environment.

The container containing a toner according to the present invention comprises the toner according to the present invention and a bottle. Accordingly, the toner encapsulated in the container may be utilized for forming images by means of electrophotography without the concerns for human body and environment.

The process cartridge according to the present invention comprises a latent electrostatic image bearing member, and a unit for developing an electrostatic image to form a visible image using the toner according to the present invention.

The process cartridge allows installation and removal to an image forming apparatus, and may provide high conveniences, and also may allow an image formation without the concerns for human body and environment, since the toner according to the present invention is applied.

The image forming apparatus according to the present invention comprises a latent electrostatic image bearing member, a forming unit configured to form an electrostatic latent image on the latent electrostatic image bearing member, a developing unit configured to develop an electrostatic latent image using a toner to form a visible image, a transferring unit configured to transfer the visible image to a recording medium, and a fixing unit configured to fixing the transferred image on the recording medium, wherein the toner comprises a toner raw composition which comprises a foaming agent, a binder resin and a colorant, the colorant comprises a black metal compound, the foaming agent has a volume-average particle diameter of 2 μm to 50 μm, the toner raw composition turns into a porous mixture while the foaming agent expands at melting and kneading the raw composition, and the toner obtained through milling and classifying the porous mixture has a specific density of 1.0 $g/cm^3$ to 1.3 $g/cm^3$.

In the image forming apparatus, the forming unit forms the electrostatic latent image on the latent electrostatic image bearing member; the transferring unit transfers the visible image to the recording medium; and the fixing unit fixes the transferred image on the recording medium; with the result that images with high quality may be formed without the concerns for human body and environment.

The image forming process according to the present invention comprises the steps of: forming an electrostatic latent image on a latent electrostatic image bearing member, developing the latent electrostatic image by means of a toner to form a visible image; wherein the toner comprises a toner raw composition which comprises a foaming agent, a binder resin and a colorant, transferring the visible image to a recording medium, fixing the transferred image on the recording medium, and the colorant comprises a black metal compound, wherein the foaming agent has a volume-average particle diameter of 2 μm to 50 μm, the toner raw composition turns into a porous mixture while the foaming agent expands at melting and kneading the toner raw composition, and the toner obtained through milling and classifying the porous mixture has a specific density of 1.0 $g/cm^3$ to 1.3 $g/cm^3$.

In the image forming process, the electrostatic latent image is formed on the latent electrostatic image bearing member in the forming step, the visible image is transferred in the transferring step; and the transferred image is fixed on the recording medium in the fixing step; with the result that images with high quality may be formed without the concerns for human body and environment.

DESCRIPTION OF THE PREFERRED EMBODIMENTS (Toner)

Figure 1:
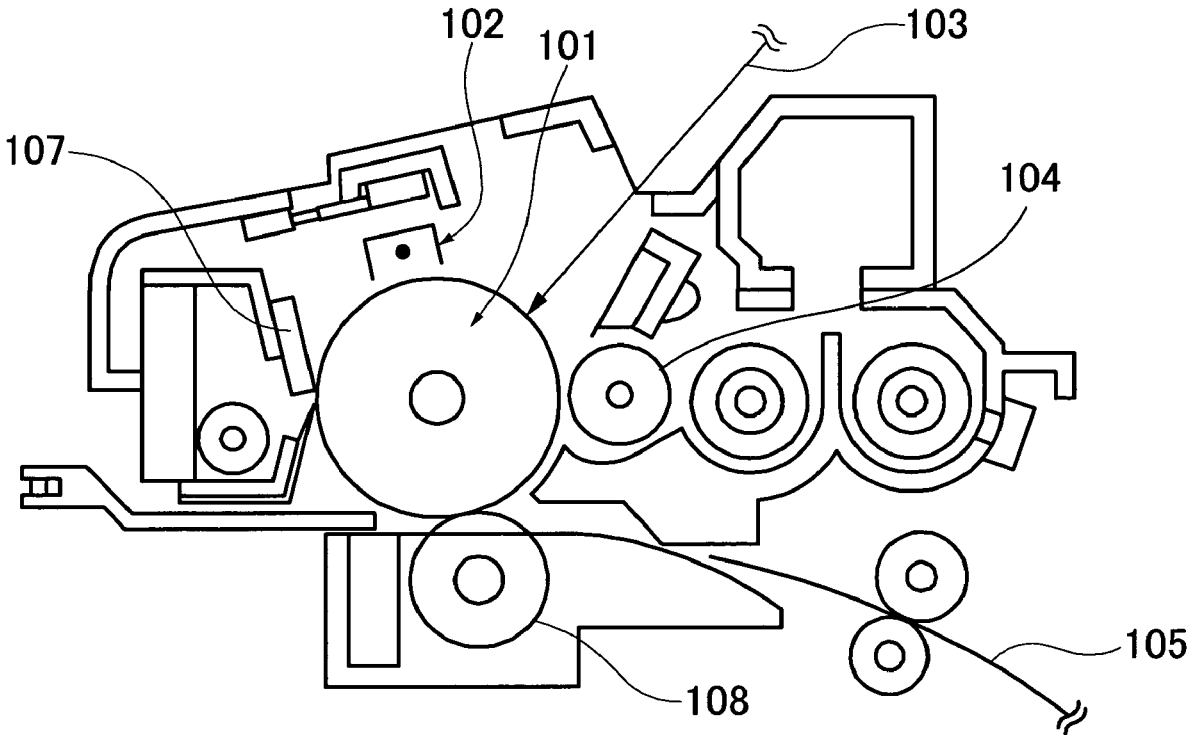
FIG. 1 is an exemplary schematic diagram of a process cartridge according to the present invention.

The toner according to the present invention may be produced from a toner raw composition which comprises a foaming agent, a binder resin and a colorant, the toner raw composition may contain the other ingredients such as a releasing agent and charge controlling agent, which are optionally selected depending on the application.

(Colorant)

The colorant comprises a black metal compound, and may contain the other ingredients depending on the application.

The black metal compound may be properly selected depending on the application without particular limitations. For example, a black metal compound is preferred that contains one of the metal oxide of which metal is selected from Al, Si, Ti, V, Mn, Fe, Co, Cu, Nb, Mo and Sn. Examples of the black metal compound include magnetite, Mn containing Fe oxide pigment of hematite structure, $Fe_2O_3$—$Mn_2O_3$, titanium oxide sintered body, MnFe ferrite, TiFe ferrite, black pigment powder consisting of polycrystalline particulates having mixed composition of $Fe_2O_3$—$FeTiO_3$ solid solution, and black pigment of complex oxide containing Co, Fe and Cr, and the like. Each of these may be used alone or in combination.

In the case that the black metal compound is utilized as a colorant, preferably, the black metal compound is compounded in the content of 10 to 50% by mass in the toner raw composition. When the content is less than 10% by mass, the level of blackness may be insufficient. When the content is more than 50% by mass, the pore volume is inevitably increased up to 35% by volume or more, resulting in the toner fragileness, shorter toner life due to carrier smear, and the occurrences of toner adhesion on developing sleeves.

By the way, since the pigments of metal oxides exhibit higher specific gravities, the volume of pigment per mass is lower than that of carbon black, accordingly, when the pigments are compounded at the same mass with carbon black, the blackness level of the toner is lower than that of carbon black, since the pigment volume in the toner is relatively low. Generally, in order to maintain the equivalence as pigment volume in the toner, the pigment is required to exist at the amount multiplied by the following coefficient calculated by Formula (1).

$$\text{Coefficient}=\rho_M/\rho_{CB} \quad \text{Formula (1)}$$

wherein $\rho_M$ is the specific gravity of black metal compound, $\rho_{CB}$ is the specific gravity of carbon black.

Conventional carbon black exhibits a specific gravity of about 1.8 g/cm$^3$, and black metal compounds exhibit specific gravities of about 5 g/cm$^3$. In this connection, when a black metal compound is to be replaced to carbon black, about 2.5 to 3 times by mass of the black metal compound corresponds to the equivalent pigment volume to carbon black. For example, the specific density of the toner, which contains carbon black at 10% by mass, amounts to 1.14 g/cm$^3$, on the other hand, the specific density of the toner, which contains $Fe_3O_4$ having the specific gravity of 5.2 g/cm$^3$ at 30% by mass, amounts to 1.14 g/cm$^3$.

By the way, the specific density of toner is defined as follows in this specification.

1 gram of toner is pressed at 400 kgf/cm$^2$ for five minutes in a discal cavity having a diameter of 20 mm, then the discal toner is removed; the discal toner volume (V) is calculated from the diameter and height, measured at 10 minutes after releasing the pressure on the discal toner, and the discal toner mass (W) is measured; then the specific density is determined from the following Formula (2).

$$\text{Specific Density } (\rho_T)=W/V \quad \text{Formula (2)}$$

Therefore, the higher specific density derives some undesirable matters as follows, when the black metal compounds are utilized as pigments.

When a permeability sensor is utilized which is a typical controlling device in a system employing magnetic carrier, a higher specific density of toner leads to a higher toner concentration, as the result, such problems appear as excessively high image concentration due to lowered electrification charge, toner deposition on the background, and excessively high consumed amount of the toner.

Further, in the remainder (mass) detection by means of vibration capacity, which is conventional as toner remainder detection type in the single-component system, when the specific density of toner comes to higher, the toner volume comes to excessively lower at the time when the lower limited weight should be detected; consequently an extraordinary image such as a weak image may be induced.

In such a case, the toner containing the black metal compound is necessary to be reduced with respect to the specific density to the range of 1.0 to 1.3 g/cm$^3$ so as to reduce the difference from the toner containing carbon black.

In an aspect of the present invention, a toner is produced wherein a toner raw composition is prepared which comprises a foaming agent, a binder resin and a colorant, and the foaming agent is expanded at the step of melting and kneading, and then the resultant porous mixture is milled and classified.

Preferably, the saturation magnetization of the black metal compounds is 10 Am$^2$/kg or less, more preferably 0 to 8 Am$^2$/kg. When the saturation magnetization is more than 10 Am$^2$/kg, the developing properties may be affected in double-component developing agent, and the image concentration may be reduced.

By the way, the saturation magnetization may be determined at the measuring magnetic field of 796 m$^2$/kg by means of Multi-Sample Rotary Magnetization Measuring Device (Model REM-1-10, by Tohei Kogyo) for example.

Preferably, the number-average particle diameter of the black metal compound is 0.02 to 0.3 μm, more preferably 0.05 to 0.2 μm. When the number-average particle diameter is less than 0.02 μm, such problems as image fogging may be induced due to the inferior dispersion ability, on the other hand when the number-average particle diameter is more than 0.3 μm, much amount of the black metal compound must possibly be used due to the insufficient black level.

Although the number-average particle diameter may be determined by means of Particle Size Measuring Device based on dynamic optical scattering, preferably it is determined based on the photograph by TEM (Transmission Electron Microscope) since the secondary agglomeration of the primary particles is difficult to be dissociated.

The colorant other than black metal compounds may be properly selected from the conventional dyes and pigments depending on the capplication; such dyes and pigments include, but are not limited to, Naphthol Yellow S, Hansa Yellow (10G, 5G, and G), cadmium yellow, yellow iron oxide, yellow ochre, yellow lead, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and the like. Each of these may be used alone or in combination.

Further, some hue gap may take place along with a lower amount of attached toner in the case that only the black metal oxide is utilized as the colorant. Therefore, it is preferred that a complementary colorant is utilized together so as to complement and prevent the hue gap.

(Foaming Agent)

The foaming agent may be properly selected depending on the application without particular limitations. For example, the foaming agent may be inorganic or organic material that may generate gas owing to its vaporization or dispersion at the temperature of 60 to 300° C. As for the inorganic foaming agent, for example, hydrogencarbonate of alkaline metal such as potassium hydrogencarbonate, sodium hydrogencarbonate; hydrogencarbonate of heavy metal such as mercury, cadmium; ammonium hydrogencarbonate, ammonium carbonate, ammonium nitrate may be exemplified.

As for the organic foaming agent, for example, nitroso compounds, azo compounds, sulfohydrazide compounds, N,N'-dinitrosopentamethylenetetraamine, azobisisobutylonitryl, diazocarbonamide, diphenylsulfon-3,3'-disulfohydrazine, 4,4'-oxybis (benzenesulfonylhydrazide), arylbis (sulfohydrazide), 5-morpholine-N,N'-dimethyl-N,N'-dinitroterephthalamide, diaminobenzene, Flon 11, Flon 12, Flon 114 may be exemplified. Each of these foaming agents may be utilized alone or in combination.

Preferably, the foaming agent is added to the toner raw composition at the amount of 2 to 20% by mass, more preferably 5 to 15% by mass. When the added amount is less than 2% by mass, the pore content in the porous mixture may be 10% by volume or less, on the other hand, when it is more than 20% by mass, such undesirable problems as lowered charge of toner may be induced.

Preferably, the foaming agent has a volume-average particle diameter of 2 to 50 μm, more preferably 2 to 30 μm. When the volume-average particle diameter is less than 2 μm, the foaming agent may exhibit a poor dispersibility due to its significant agglomeration at pre-mixing step of the raw materials. On the other hand, when the volume-average particle diameter is more than 50 μm, some difference of developing property may be induced between initial and elapsed periods due to a selecting phenomena caused by various pore contents of the individual toner particles.

The reason, why the background concentration of the organic photo-conductor (OPC) may be reduced owning to the pores contained in the toner, wherein the pores is formed through expanding the foaming agent at the melting and kneading step, is not clear but believed that an effect for suppressing inductive charge may be arisen in the condition where a metal oxide powder is utilized as a pigment and pores exist, since the permittivity reduces while pores are included.

Further, a foaming aid agent is preferably added with a foaming agent; stearic acid, urea and the like are exemplified as such foaming aid agent.

(Binder Resin)

The binder resin may be properly selected from the conventional resins utilized for toner binder resins. Examples the binder resin include styrene based resins such as polystyrene resins, styrene-acrylic acid copolymers, styrene-methacrylic acid copolymers, styrene-acrylate copolymers, styrene-methacrylate copolymers, styrene-butadiene copolymers; saturated polyester resins, unsaturated polyester resins, epoxy resins, phenol resins, maleic acid resins, coumarone acid resins, paraffin chloride resins, xylene resins, polyvinyl chloride resins, polypropylene resins, and polyethylene resins. Each of these may be used alone or in combination.

The content of the binder resin in the toner is not limited to a certain range but suitably selected depending on the application, preferably the content is 4 to 90% by mass, more preferably 55 to 80% by mass.

Preferably, the particles of the binder resins have an average particle size of 2 mm or less. When the average particle size is more than 2 mm, the binder resin and the foaming agent may not be compounded into a sufficiently uniform condition, resulting in a localized distribution of pores and fluctuation of specific density of toner, thereby such undesirable problems are induced as carrier smear and developer contamination.

(Other Ingredients)

The releasing agent may be properly selected from the conventional agents depending on the application, preferably the agents include waxes for example.

The waxes may be carbonyl-containing waxes, polyolefin waxes, and long chain hydrocarbons for example. These waxes may be used alone or in combination. Among these waxes, carbonyl-containing waxes are more preferred.

The waxes containing carbonyl group may be, for example, polyalkanoic acid esters, polyalkanol esters, polyalkanoic acid amides, polyalkylamides, and dialkyl ketones for example. The polyalkanoic acid esters include, for example, carnauba wax, montan wax, trimethylolpropane tribehenate, pentaerythritol tetrabehenate, pentaerythritol diacetate dibehenate, glycerol tribehenate, and 1,18-octadecanediol distearate. The polyalkanol esters include, for example, tristearyl trimellitate and distearyl maleate. The polyalkanoic acid amides include, for example, ethylenediaminedibehenamide. The polyalkylamides include, for example, tristearylamide trimellitate. The dialkyl ketones include, for example, distearyl ketone. Among these carbonyl-containing waxes, preferred are polyalkanoic acid esters.

The polyolefin waxes include, for example, polyethylene wax and polypropylene wax. The long chain hydrocarbons include, for example, paraffin wax and Sazol wax.

The content of the releasing agent may be properly selected depending on the application without particular limitations, preferably the content is 0 to 40% by mass, more preferably 3 to 30% by mass.

The charge-controlling agent is added in order to impart a charging ability to the toner. As for the charge-controlling agent which imparts positive property to the toner, nigrosine dyes, quaternary ammonium salts, basic dyes, and amino-containing polymers may be exemplified. As for the charge-controlling agent which imparts negative property to the toner, chromium-containing monoazo dyes chlorine-containing organic dyes, and metal salts of salicylic acid derivatives may be exemplified.

To the toner according to the present invention, the other additives may be incorporated depending on the requirements. As for the other additives, fluidity-enhancing agent, cleaning agent (cleaning improver), magnetic material, polishing material, anti-caking agent, and conductivity-imparting agent may be exemplified.

The fluidity-enhancing agent indicates such agent that allows maintaining the fluidity even in a high-humidity atmosphere, through a surface treatment with the agent so as to enhance the hydrophobic nature. As for the fluidity-enhancing agent, silane coupling agent, sililating agent, silane coupling agent having a fluorinated alkyl group, organic titanate coupling agent, aluminum coupling agent, silicone oil, and modified silicone oil may be exemplified.

A cleaning agent may be added in order to remove the developer remained on a photoconductor or on a primary transfer member after the transferring step. Suitable cleaning agents are, for example, metal salts of fatty acid such as zinc stearate and calcium stearate.

The magnetic material may be properly selected depending on the application without particular limitations, for example, iron powder, magnetite, and ferrite may be exemplified. Among these, white materials are preferred in light of tonality.

In the toner according to the present invention, such physical factors as shape and size may be properly adjusted depending on the application without particular limitations; preferably, the toner according to the present invention has the following properties with respect to average circularity, volume-average particle size, ratio of volume-average particle size to number-average particle size (volume-average particle size/number-average particle size), and dielectric loss tangent (tan δ).

The average circularity indicates a value obtained by dividing the circumferential length of an equivalent circle identical to a projected area by the circumferential length of the actual particles, it is preferred that the average circularity is 0.940 to 0.960, more preferably 0.945 to 0.955. Further, the rate of particles having a circularity of less than 0.94 is preferred to be 10% or less.

The average circularity may conveniently be measured by passing a suspension containing the toner particles through an imaging part detection belt on a flat plate, optically detecting a particle image with a CCD camera, and performing an analytical, optical detection, for example, this value was measured by means of a flow type particle image analyzer FPIA-2100 (To a Medical Electronics Co., Ltd.).

It is preferred that the volume average particle diameter (Dv) of the toner particles is 4 to 8 μm. When the volume average particle diameter is less than 4 μm, in a double-component developer, the toner may stick to the carrier surface when stirred for a long period in the developing apparatus which impairs the charge capability of the carrier, and when used as a single-component developer, filming of toner on the developing roller or sticking of toner to blades or other members used to thin the toner layer, tends to occur. On the other hand, when the volume average particle diameter of toner particles is larger than 8 μm, it becomes difficult to obtain a high-definition image of high resolution.

In the toner of the present invention, it is preferred that the volume average particle diameter/number average particle diameter of toner particles (Dv/Dn) is 1.25 or less, more preferably 1.10 to 1.25.

In the toner of the present invention, it is preferred that the dielectric loss tangent (tan δ) is $3\times10^{-3}$ to $15\times10^{-3}$, more preferably $3\times10^{-3}$ to $10\times10^{-3}$. When the dielectric loss is less than $3\times10^{-3}$, the image concentration may be lower since the attenuation rate of charge comes to lower and the charged level increases, on the other hand when dielectric loss is more than $15\times10^{-3}$, such undesirable problems may occur as image fogging, increment of consumed toner, and scattering of toner, due to the decreased charge as the result of premature attenuation of charge.

By the way, the dielectric loss tangent may be determined by the following formula:

$$\tan\delta = G/(2\pi\times f\times C)$$

wherein G: capacitance of toner, f: frequency

C: conductance of toner

The toner according to the present invention may be produced in the process according to the present invention especially in a proper manner, as described in the following; although the toner may be produced in a well-known manner such as a milling step, suspension polymerization, emulsified polymerization coagulation, and polymer solution suspension process.

(Process for Producing Toner)

The process for producing the toner according to the present invention is a process for producing the above-noted toner according to the present invention, which comprises a melting and kneading step, milling and classifying step, and also the other steps properly selected depending on the necessity.

In the melting and kneading step, a toner raw composition, which comprises a foaming agent, a binder resin and a black metal compound as colorant, is melted and kneaded, and the foaming agent is expanded.

In order to expand the foaming agent during the melting and kneading step, the step is carried out at beyond the melting temperature of the binder, ordinarily at 50 to 200° C. In an embodiment, the melting and kneading step is carried out through pouring the raw materials into a melting kneader. Such a melting kneader includes, for example, single-screw or twin-screw continuous kneader, and roll-mill batch-system kneader. These kneaders are commercially available, for example, as a twin-screw extruder Model KTK from Kobe Steel Co., Ltd., a TEM series co-rotating twin-screw compounder from TOSHIBA MACHINE Co., Ltd., a twin-screw extruder from KCK Tool & Die, Co., a twin-screw extruder Model PCM from Ikegai, Ltd., and a co-kneader from Buss Co., Ltd.

The melting and kneading step must be performed under appropriate conditions so as not to cause cleavage of molecular chains of the binder resin. More specifically, the melting and kneading temperature should be set considering the softening point of the binder resin. When it is excessively lower than the softening point, the molecular chains of the binder resin are significantly cleaved, on the other hand, when excessively higher than the softening point, the components may not be sufficiently dispersed.

Preferably, the size of pores in the porous mixture (its diameter in the case that the pore is sphere, its diagonal in the case that the pore is square) is 0.2 to 20 μm, more preferably 0.2 to 15 μm. When the pore size is less than 0.2 μm, the resin tends to decline in its toughness, and the particle size distribution of the toner tends to be broad caused by an excessive milling, on the other hand, when the pore size is more than 20 μm, the individual toner particles may not maintain the level of the pore content.

The pore size may be determined by observing the cross-section of the mixture by means of SEM (Scanning Electron Microscope).

Preferably, the volume content of pores in the porous mixture is 10 to 30% by volume. When the volume content of pores is less than 10% by volume, the specific density of the toner may not be adjustable to less than 1.3 g/cm$^3$, on the other hand, when more than 30% by volume, the toner may be unavailable since the carrier fouling comes to be significant due to the stress in the developer derived from brittleness of the toner.

In the milling and classifying step, the resultant porous mixture is milled and classified. Preferably, the milling step carries out rough pulverization of the kneaded product as well as fine grinding of the roughly pulverized particles. The step of pulverizing is preferably performed according to a collision milling step in which the particles are allowed to collide with a collision plate or to collide each other in a jet stream, or a step in which the particles are milled in a narrow gap between a mechanically rotating rotor and a stator. Following to the milling step, the particles are classified by means of centrifugal force, thereby a toner may be prepared that has a volume-average particle size of 4 to 8 μm for example.

(Developer)

The developer according to the present invention comprises the toner according to the present invention, and the other ingredients such as carrier selected properly. The developer may be a single-component or double-component developer; however, the developer is preferably of single-component type in light of such factor as prolonged life, in order to be applied to high-speed printers for the purpose of nowadays-increased information processing rate.

In the case of the single-component developer comprising the toner according to the present invention, even after consumption and addition of the toner, the variation of the toner particle diameter is minimized, filming of the toner to a development roller, and toner fusion to members such as a toner blade which controls the toner thickness on the development roller are also prevented, and also excellent and stable developing properties and images may be obtained even after the developing apparatus is utilized (stirred) for a long period. Further, in the case of the double-component developer comprising the toner according to the present invention, even after prolonged consumption and addition of the toner, the variation of the toner particle diameter is minimized, and even after the developing apparatus is stirred for a long period, excellent and stable developing properties may be obtained.

The carrier may be properly selected, without particular limitations, depending on the application, preferably the carrier is one having core and resin layer coating on the core material.

The material for the core may be properly selected from conventional materials without particular limitations; for example, the material based on manganese-strontium (Mn—Sr) of 50 to 90 emu/g and the material based on manganese-magnesium (Mn—Mg) are preferable, high magnetizing materials such as iron powder (100 emu/g or more) and magnetite (75 to 120 emu/g) are preferable from the standpoint of securing image density. Also, weak magnetizing materials such as of copper-zinc (Cu—Zn) (30 to 80 emu/g) are preferable from the standpoint for aiming higher-grade images by means of softening the contacts of the toner to the photoconductor where the toner is standing. Each of these materials may be employed alone or in combination.

As for the particle diameter of the core material, preferably the average particle diameter (volume-average particle diameter ($D_{50}$)) is 10 to 150 μm, more preferably 40 to 100 μm. When the average particle diameter ($D_{50}$) is less than 10 μm, the carrier particle distribution contains fine particle in significant fraction, which may cause carrier scattering due to lowered magnetization per one particle; on the other hand, when it exceeds 150 μm, the specific surface area comes to lower, which may cause toner scattering and deteriorate the production quality of the contact printing part for full-color printing.

The material for the resin layer may be properly selected from conventional materials depending on the application without particular limitations; examples of the material for the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoro ethylene resins, polyhexafluoropropylene resins, copolymers of vinylidene fluoride with acrylic monomer, copolymers of vinylidene fluoride with vinyl fluoride, fluoroterpolymers such as the terpolymer of tetrafluoroethylene, vinylidene fluoride and a non-fluoride monomer, and silicone resins. Each of these resins may be used alone or in combination.

The amino resins include, for example, urea-formaldehyde resins, melamine resins, benzoguanamine resins, urea resins, polyamide resins, epoxy resins, and the like. The polyvinyl resins include acrylic resins, polymethyl methacrylate resins, polyacrylonitrile resins, polyvinyl acetate resins, polyvinyl alcohol resins, polyvinyl butyral resins, and the like. The polystyrene resins include polystyrene resins, styrene-acryl copolymer resins and the like. The halogenated olefin resins include polyvinyl chloride and the like. The polyester resins include polyethylene terephthalate resins, polybutylene terephthalate resins and the like.

The resin layer may be contained such material as conductive powder depending on the application; as for the conductive powder, metal powder, titanium oxide, tin oxide, zinc oxide, and the like are exemplified. These conductive powders preferably have an average particle diameter of 1 μm or less. When the average particle diameter is more than 1 μm, it may be difficult to control electrical resistance.

The resin layer may be formed by first dissolving the silicone resins into a solvent to prepare a coating solution, then uniformly coating the surface of the core material with the coating solution by means of the immersion process, the spray process, the brush painting process and the like, and baking it after drying.

There is no particular limitation for the solvent and it may be selected suitably from toluene, xylene, methylethylketone, methylisobutylketone, and celsorbutylacetate and the like.

The baking process may be an externally heating process or an internally heating process, and can be selected from, for example, a process using either a fixed type electric furnace, a fluid type electric furnace, a rotary type electric furnace, and a burner furnace, or a process of using microwave and the like.

The ratio of the resin layer (resin coating amount) in the carrier is preferably 0.01 to 5.0% by mass base on the entire amount of the carrier. When the ratio is less than 0.01% by mass, it is difficult to form a uniform resin layer, on the other hand, when the ratio exceeds 5.0% by mass, the resin layer becomes too thick and particle formation between carriers occurs, as the result uniform carrier fine particles may not be obtained.

When the developing agent for electrophotography is one of the double-component developing agents, the contents of the carrier in the double-component developing agent is not particularly restricted and may be properly selected depending on the application, for example it is preferably 90 to 98% by mass, more preferably 93 to 97% by mass.

As for the mass ratio of the toner and carrier in the double-component developer, toner is 0.5 to 20.0 parts by mass based on 100 parts by mass of the carrier, in general.

Since the developer according to the present invention comprises the toner according to the present invention, both of the electrostatic property and the fixing property may be maintained during the image forming process in a well-balanced manner, and images of high quality may be realized stably.

The developer according to the present invention may be applied to the image forming by means of publicly known various electrophotography such as a magnetic single-component developing process, non-magnetic single-component developing process, double-component developing process, and also employed in an especially suitable manner to the container containing the toner, a process cartridge, an image forming apparatus, and an image forming process, which will be explained in the following.

(Container Containing Toner)

The container containing the toner according to the present invention comprises the toner or developer according to the present invention and a bottle.

The container may be properly selected from conventional containers without particular limitations, for example, the container may be suitably exemplified which comprises a container main body and a cap.

The size, shape, configuration, material and the like of the container may be properly selected depending on the application without particular limitations. For example, the shape is preferably cylindrical, and such configuration is particularly preferable that spiral convexo-concave grooves are formed on the inner surface so as to allow the toner, which is the content of the container, shift to the exit with involving motion, and all or part of the spiral grooves provide a bellows function.

The material for the container main body may be selected without particular limitations and may preferably be selected from the materials which may provide suitable dimension accuracy; the material may be resin, for example, of polyester resins, polyethylene resins, polypropylene resins, polystyrene resins, polyvinyl chloride resins, polyacrylic acid resins, polycarbonate resins, ABS resins, polyacetal resins, and the like.

The container containing the toner according to the present invention may provide easy storing and transporting abilities, and excellent handling property, and may be utilized for supplying the toner by attaching to the process cartridge, image forming apparatus and the like in a way to allow installation and removal.

(Process Cartridge)

The process cartridge according to the present invention comprises an electrostatic latent image carrier which bears an electrostatic latent image, and a developing unit to develop the electrostatic latent image on this electrostatic latent image carrier using a developer to form a visible image, and other units suitably selected depending on the application.

The developing unit comprises a developer container which houses the toner or developer according to the present invention, and a developer carrier which bears and transports the toner or developer in the developer container, and may further comprise a layer-thickness adjusting member for adjusting the thickness of toner layer.

The process cartridge according to the present invention may preferably be attached to or removed from various electrophotographic apparatuses, and may preferably be attached to or removed from the electrophotographic apparatus of the present invention, described later.

The process cartridge comprises a latent electrostatic image bearing member 101, and also charging device 102, exposing device 103, development device 104, transfer material 105 (e.g. paper), cleaning device 107 and transfer device 108, and the other members depending on the application.

The photoconductor 101 comprises a support and photoconductive layer which comprises a charge generation layer, charge transport layer, and cross-linked type charge transport layer in this order. The charging device 102 may be formed from a conventional charging material, and may provide corona discharge so as to emerge a field intensity of 30 V/μm or more (less than 60 V/μm, preferably less than 50 V/μm) at the photoconductor when images are to be formed precisely.

A light source adaptable for writing at high resolution may be employed for the exposing device 103. Any charging member (preferably scorotron charge) may be employed for the charging device 102.

The image forming apparatus according to the present invention may constitute a process cartridge by integrally combining the above-noted photoconductor, developer cleaner and other components, and configuring as detachable from and attachable to the main body of the apparatus. Alternatively, a process cartridge may be provided by integrally supporting the photoconductor and at least one of charger, light irradiator, image-transfer, separator and cleaner to form a single unit detachable from or attachable to the main body of the apparatus by action of guide means such as a rail of the main body of the apparatus.

Figure 2:
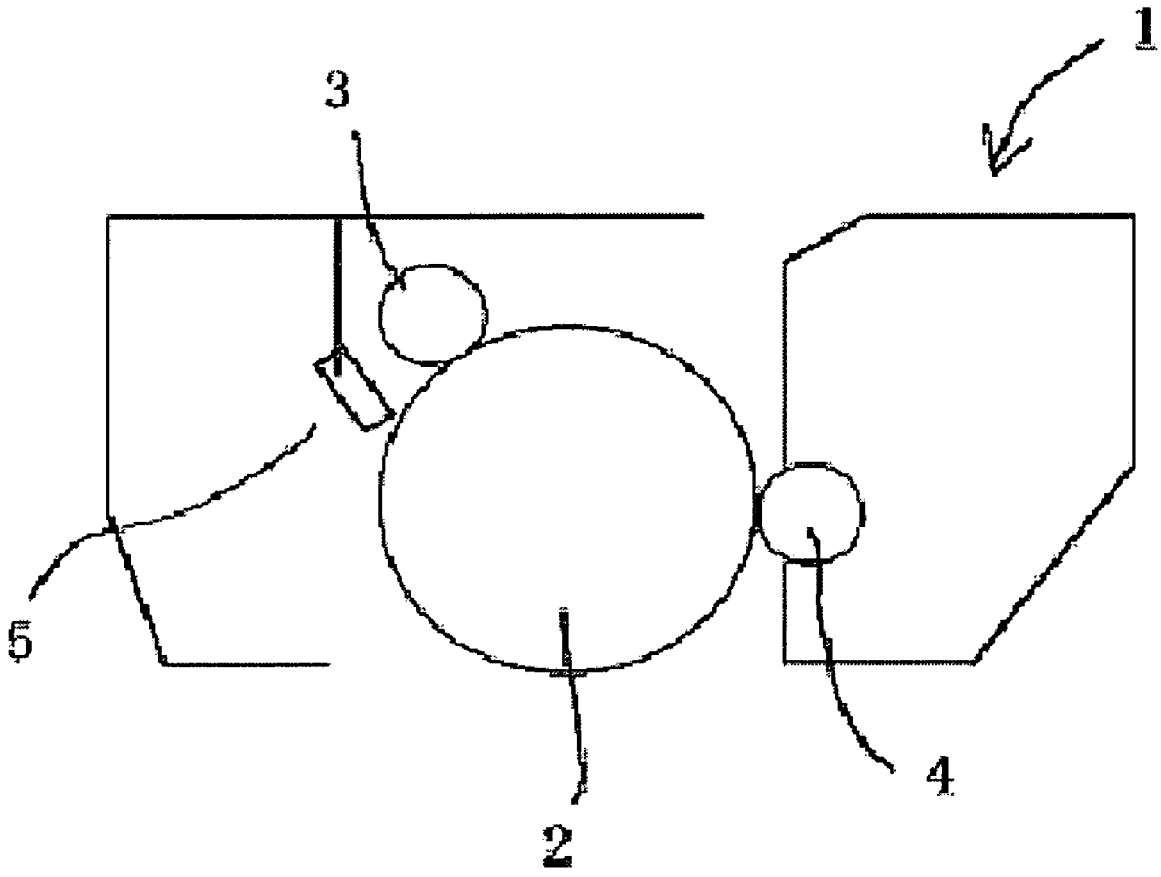
FIG. 2 is an exemplary schematic diagram of an image forming apparatus which comprises a process cartridge according to the present invention.

FIG. 2 schematically illustrates, for example, an image forming apparatus which comprises a process cartridge which support the developer according to the present invention.

In FIG. 2, (1) indicates an entire process cartridge, (2) indicates a photoconductor, (3) indicates a charging unit, (4) indicates a developing unit, and (5) indicates a cleaning unit.

In the present invention, the process cartridge may be constituted by integrally combining at least the developing unit 4 and the other components selected from photoconductor 2, charging unit 3, and cleaning unit 5, and the process cartridge may be utilized in an attachable and detachable constitution to the image forming apparatus such as copier or printer.

(Image Forming Apparatus and Image Forming Process)

The image forming apparatus according to the present invention comprises a latent electrostatic image bearing member, latent electrostatic image forming unit, developing unit, transfer unit and fixing unit, and may further comprise the other units, for example, charge-eliminating unit, cleaning unit, recycling unit and control unit, if required.

The image forming process according to the present invention comprises a latent electrostatic image forming step, developing step, transfer step and fixing step, and may further comprise the other steps, for example, a charge-eliminating step, cleaning step, recycling step and control step, if required.

Further, in the image forming apparatus according to the present invention, preferably, a unit for applying an alternative electric field is provided in the step of developing the latent image on the image bearing member.

By providing the unit for applying an alternative electric field, images with high precision and without significant roughness may be obtained, since an oscillating bias voltage, i.e. alternating voltage being duplicated to the direct voltage, is applied during the period when the latent images are developed by means of the developer.

The image forming process according to the present invention may be suitably applied to the image forming apparatus according to the present invention. The latent electrostatic image forming step may be performed by the latent electrostatic image forming unit, the developing step may be performed by the developing unit, the transfer step may be performed by the transfer unit, and the fixing step may be performed by the fixing unit. The other steps may be performed by the other unit.

(Latent Electrostatic Image Forming Step and Latent Electrostatic Image Forming Step)

The latent electrostatic image forming step is one which forms a latent electrostatic image on the latent electrostatic image bearing member.

The latent electrostatic image bearing member (hereinafter, sometimes referred to as "photoconducting insulator" or "photoconductor") is not particularly limited as to the material, shape, construction or size, and may be suitably selected from among those known in the art. For example, its shape may be drum-like, and its material may be that of an inorganic photoconductor, such as amorphous silicon or selenium, or an organic photoconductor such as polysilane or phthalopolymethane. Among these, amorphous silicon is preferred from the viewpoint of long life.

The latent electrostatic image may be formed, for example, by uniformly charging the surface of the latent electrostatic image bearing member, and irradiating it imagewise, which may be performed by the latent electrostatic image forming unit.

The latent electrostatic image forming unit, for example, comprises a charger which uniformly charges the surface of the latent electrostatic image bearing member, and a light irradiator which exposes the surface of the latent image carrier imagewise.

The charging may be performed, for example, by applying a voltage to the surface of the latent electrostatic image bearing member using the charger.

The charger is not particularly limited and may be suitably selected depending on the application, for example, contact chargers known in the art such as a conductive or semi-conductive roller, brush, film or rubber blade, and non-contact chargers using corona discharge such as corotron and scorotron are exemplified.

The light irradiation may be performed by irradiating the surface of the latent electrostatic image bearing member imagewise, using the light irradiator for example.

The light irradiator is not particularly limited and may be suitably selected depending on the application provided that it may expose the surface of the latent electrostatic image bearing member charged by the charger in the same way as the image to be formed, for example, a light irradiator such as copy optical system, rod lens array system, laser optical system and liquid crystal shutter optical system may be exemplified.

In addition, in the present invention, a backlight system may be employed wherein the latent electrostatic image bearing member is exposed imagewise from its rear surface.

(Developing Process and Developing Unit)

The developing step is one which develops the latent electrostatic image using the developer of the present invention to form a visible image.

The visible image may be formed for example by developing the latent electrostatic image using the developer of the present invention, which may be performed by the developing unit.

The developing unit is not particularly limited provided that it may develop an image for example by using the developer, and may be suitably selected from among those known in the art. Examples are those which comprise an image-developer housing the developer of the present invention, and which may supply the developer with contact or without contact to the latent electrostatic image.

The image-developer may be the dry type or wet type, and may be a monochrome image-developer or a multi-color image-developer. Examples are units comprising a stirrer which charge the developer by friction stirring, and units comprising a rotatable magnet roller.

In the image-developer, the toner and the carrier may for example be mixed and stirred together. The toner is thereby charged by friction, and forms a magnetic brush on the surface of the rotating magnet roller. Since this magnet roller is arranged near the latent electrostatic image bearing member (photoconductor), part of the toner in the magnetic brush formed on the surface of this magnet roller moves to the surface of this latent electrostatic image bearing member (photoconductor) due to the force of electrical attraction. As a result, the latent electrostatic image is developed by this toner, and a visible toner image is formed on the surface of this latent electrostatic image bearing member (photoconductor).

The developer to be housed in the image-developer is the developer containing the toner according to the present invention. The developer may be single-component or double-component developer.

(Transfer Step and Transfer Unit)

The transfer step is one which transfers the visible image to a recording medium. In a preferred aspect, the first transfer is performed wherein, using an intermediate image-transfer member, the visible image is transferred to the intermediate image-transfer member, and the second transfer is then performed wherein this visible image is transferred to a recording medium. In a more preferred aspect, using toner of two or more colors and preferably full color toner, the primary transfer step transfers the visible image to the intermediate image-transfer member to form a compound transfer image, and the second transfer step transfers this compound transfer image to the recording medium.

The transfer can be realized, for example, by charging the latent electrostatic image bearing member (photoconductor) using a transfer charger, which can be performed by the transfer unit. In a preferred aspect, the transfer unit comprises a first transfer unit which transfers the visible image to the intermediate image-transfer member to form a compound transfer image, and a second transfer unit which transfers this compound transfer image to the recording medium.

The intermediate image-transfer member is not particularly limited and may be suitably selected from transfer bodies known in the art, for example, a transfer belt may be exemplified.

The transfer unit (the first transfer unit and the second transfer unit), preferably comprises an image-transferer which charges by releasing the visible image formed on the latent electrostatic image bearing member (photo conductor) to the recording-medium side. There may be one, two or more of the transfer unit.

The image-transferer may be a corona transfer unit which functions by corona discharge, a transfer belt, a transfer roller, a pressure transfer roller or an adhesion transfer unit.

The recording medium is not particularly limited and may be suitably selected from among recording media (recording papers) known in the art.

The fixing step is one which fixes the visible image transferred to the recording medium using a fixing apparatus. This may be carried out for developer of each color transferred to the recording medium, or in one operation when the developers of each color have been laminated.

The fixing apparatus is not particularly limited and may be suitably selected from heat and pressure unit known in the art. Examples of heat and pressure unit are a combination of a heat roller and pressure roller, and a combination of a heat roller, pressure roller and endless belt.

The heating temperature in the heat-pressure unit is preferably 80° C. to 200° C.

Also, in the present invention, an optical fixing unit known in the art may be used in addition to or instead of the fixing step and fixing unit, depending on the application.

The charge-eliminating step is one which applies a discharge bias to the latent electrostatic image bearing member to discharge it, which may be performed by a charge-eliminating unit.

The charge-eliminating unit is not particularly limited and may be suitably selected from charge-eliminating unit known in the art provided that it can apply a discharge bias to the latent electrostatic image bearing member, for example, a discharge lamp.

The cleaning step is one which removes electrophotographic toner remaining on the latent electrostatic image bearing member, and may be performed by a cleaning unit.

The cleaning unit is not particularly limited and may be suitably selected from cleaning unit known in the art provided that it can remove electrophotographic toner remaining on the latent electrostatic image bearing member, for example, a magnetic brush cleaner, electrostatic brush cleaner, magnetic roller cleaner, blade cleaner, brush cleaner and web cleaner are exemplified.

The recycling step is one which recycles the electrophotographic toner removed by the cleaning step to the developing step, and may be performed by a recycling unit.

The recycling unit is not particularly limited and may be suitably selected from among transport unit known in the art.

The control step is one which controls the respective processes, and may be properly implemented by a control unit.

The control unit is not particularly limited and may be suitably selected depending on the application provided that it can control the operation of each of the unit, for example, a device such as a sequencer or a computer.

The recording medium is typically plain paper, but is not specifically limited, may be selected depending on the application and includes, for example, a polyethylene terephthalate (PET) base for overhead projector (OHP).

An embodiment of the image forming process of the present invention using the image forming apparatus according to the present invention will be illustrated with reference to FIG. 3. The image forming apparatus 100 shown in FIG. 3 comprises photoconductor drum 10 (hereinafter briefly referred to as "photoconductor 10") as the latent electrostatic image bearing member, charging roller 20 as the charging unit, light irradiator 30 as the exposing unit, image-developer 40 as the developing unit, intermediate image-transfer member 50, cleaner 60 serving as the cleaning unit and having a cleaning blade, and charge-eliminating lamp 70 as the charge-eliminating unit.

The intermediate image-transfer member 50 is an endless belt, being designed such that it is spanned over three rollers 51 and driven in the direction indicated by an arrow. One of the three rollers 51 serves as a bias roller for applying a bias for image transfer to the intermediate image-transfer member 50. A cleaner 90 for cleaning the intermediate image-transfer member 50 is arranged in the vicinity of the intermediate image transfer member 50 and includes a cleaning blade. A transfer roller 80 as the transfer unit faces the intermediate image-transfer member 50 and transfers a toner image from the intermediate image-transfer member 50 to a transfer sheet 95 serving as a final transfer member. A corona charger 58 for applying charges onto the developed image on the intermediate image transfer member 50 is arranged around the intermediate image-transfer member 50. The corona charger is disposed between a contact area of the photoconductor 10 and the intermediate image transfer member 50 and another contact area of the intermediate image transfer member 50 and the transfer sheet 95 in the direction of rotation of the intermediate image transfer member 50.

The image-developer 40 is comprised of a developing belt 41 as a developer carrier, black developing unit 45K disposed around the developing belt 41, yellow developing unit 45Y, magenta developing unit 45M and cyan developing unit 45C. The black developing unit 45K includes a developer tank 42K, developer feed roller 43K and developing roller 44K. The yellow developing unit 45Y includes a developer tank 42Y, developer feed roller 43Y and developing roller 44Y. The magenta developing unit 45M includes a developer tank 42M, developer feed roller 43M and developing roller 44M. The cyan developing unit 45C includes a developer tank 42C, developer feed roller 43C and developing roller 44C. The developing belt 41 is in the form of an endless belt and is spanned over plural belt rollers rotatably, a part of which is in contact with the photoconductor 10.

Figure 3:
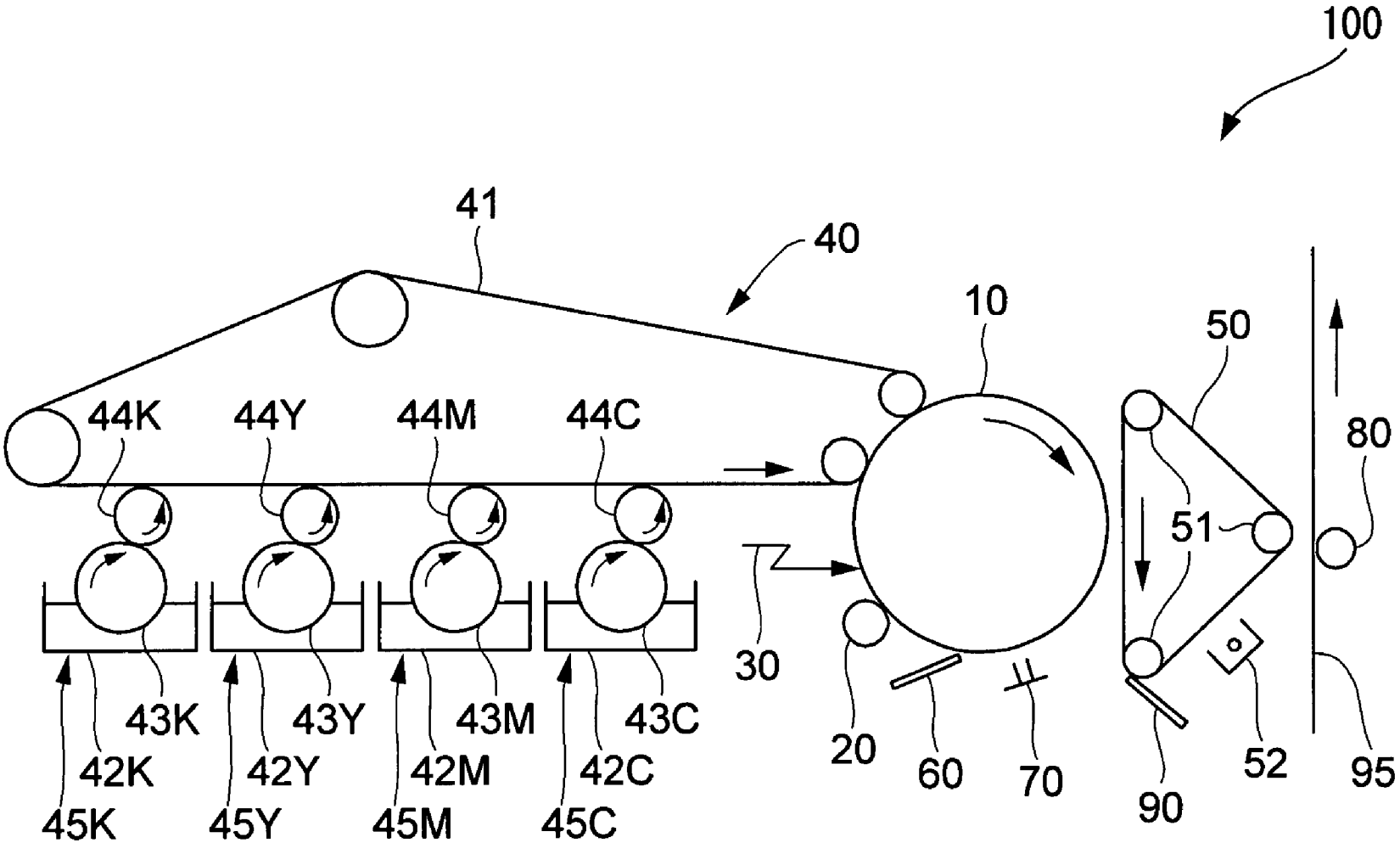
FIG. 3 is an exemplary schematic diagram of an image forming apparatus according to the present invention with which the image forming process according to the present invention may be carried out.

In the image forming apparatus 100 shown in FIG. 3, for example, the charging roller 20 uniformly charges the photoconductor 10. The light irradiator 30 applies light to the photoconductor 10 imagewise to form a latent electrostatic image thereon. The image-developer 40 feeds the developer to the photoconductor 10 to thereby develop the latent electrostatic image thereon to form a visible image. The visible image is transferred (primary transfer) to the intermediate image transfer member 50 and then transferred (secondary transfer) to the transfer sheet 95 by action of a voltage applied by the rollers 51, to thereby form a transferred image on the transfer sheet 95. Untransferred developers on the photoconductor 10 after the transferring procedure are removed by the cleaner 60, followed by elimination of residual charges by the charge eliminating lamp 70 to be subjected to another charging procedure.

Figure 4:
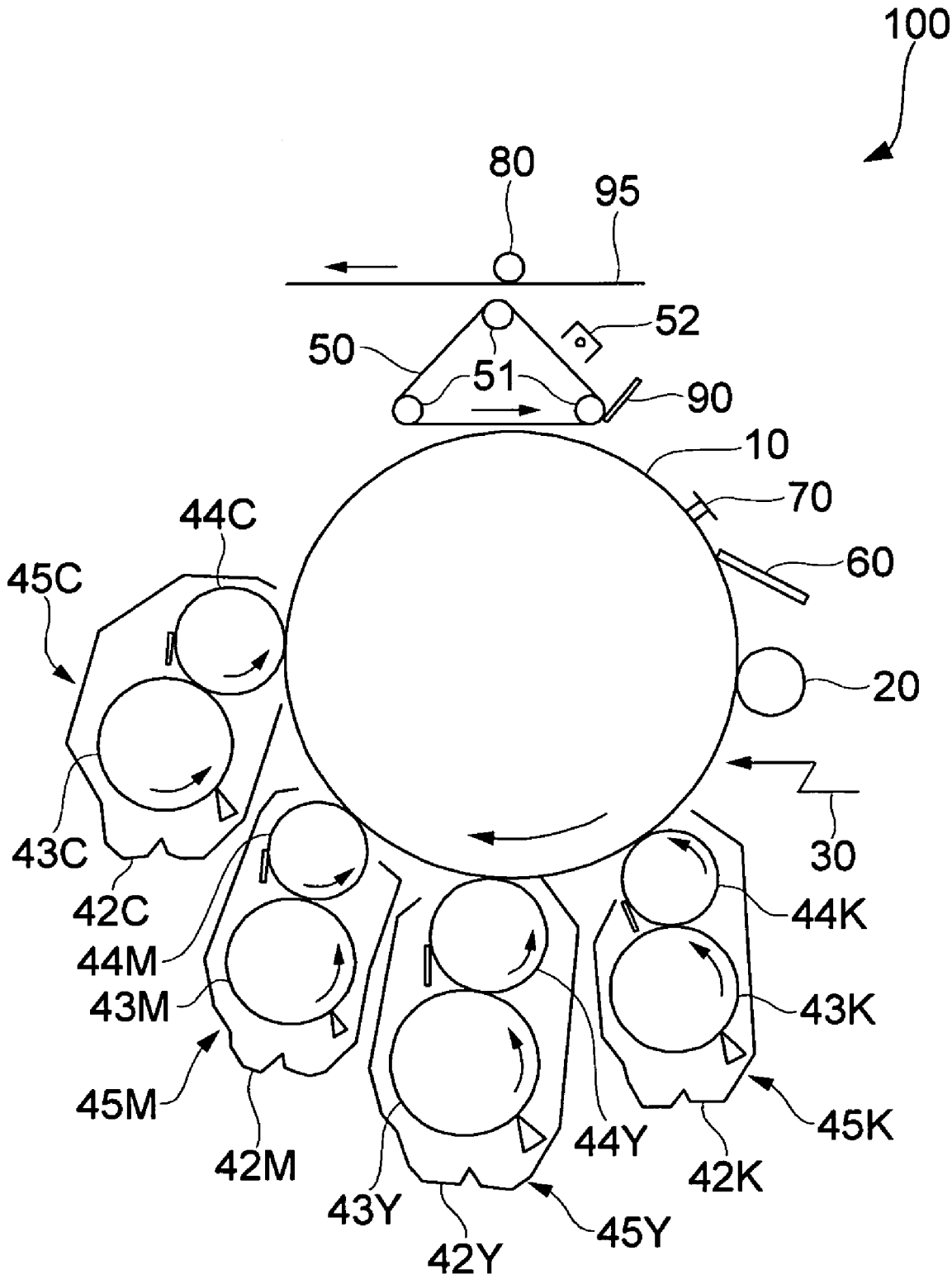
FIG. 4 is another exemplary schematic diagram of an image forming apparatus according to the present invention with which the image forming process according to the present invention may be carried out.

Another embodiment of the image forming process using the image forming apparatus will be illustrated with reference to FIG. 4. The image forming apparatus 100 of FIG. 4 has the same configuration and the same advantages as in the image forming apparatus 100 of FIG. 3, except that the image forming apparatus 100 of FIG. 4 does not include a developing belt 41, and that a black developing unit 45K, yellow developing unit 45Y, magenta developing unit 45M and cyan developing unit 45C surround and directly face a photoconductor 10. The same components of FIG. 4 as those of FIG. 3 have the same reference numerals, respectively.

Figure 5:
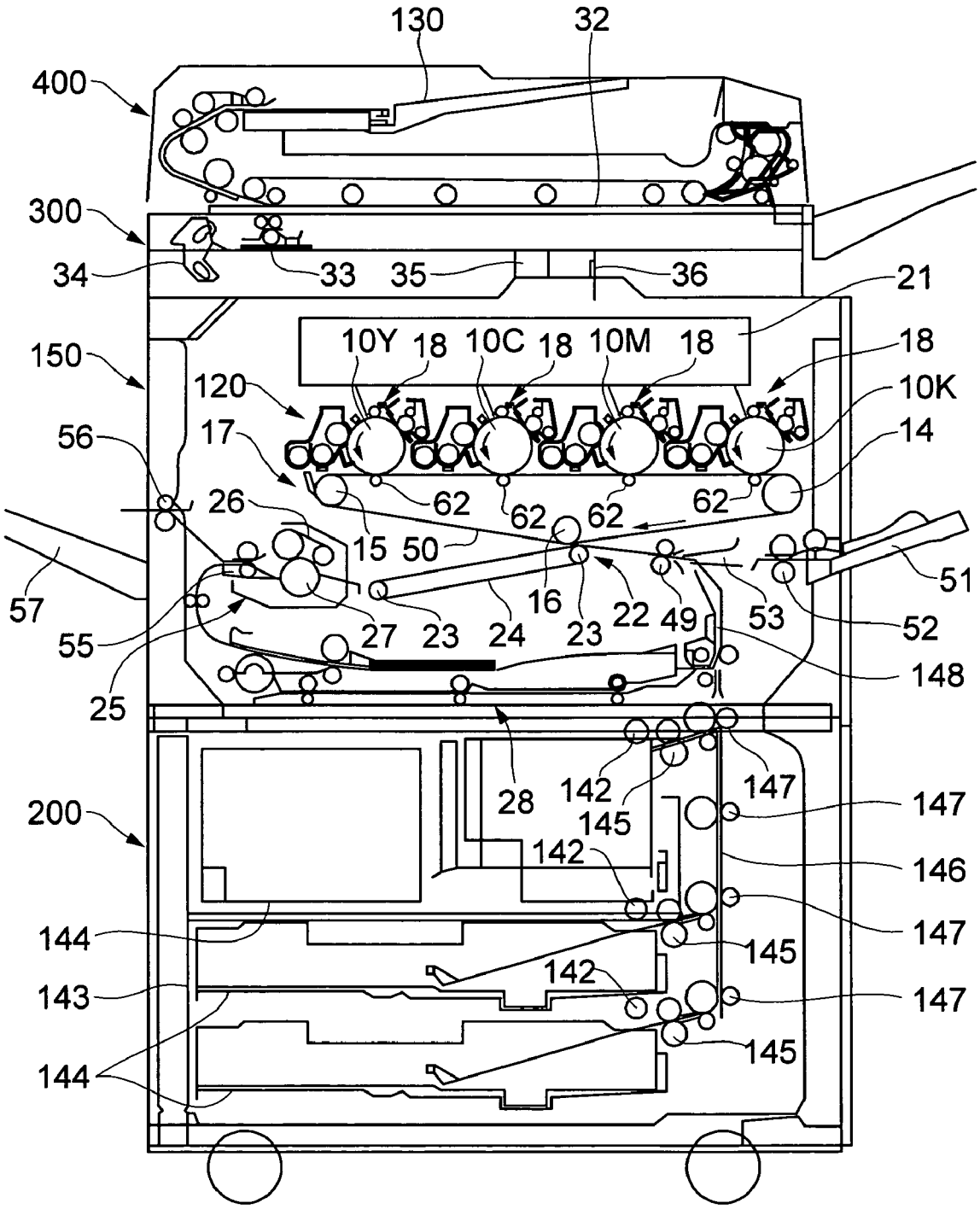
FIG. 5 is an exemplary schematic diagram of an image forming apparatus (Tandemn Type Color Image Forming Apparatus) according to the present invention with which the image forming process according to the present invention may be carried out.
Figure 6:
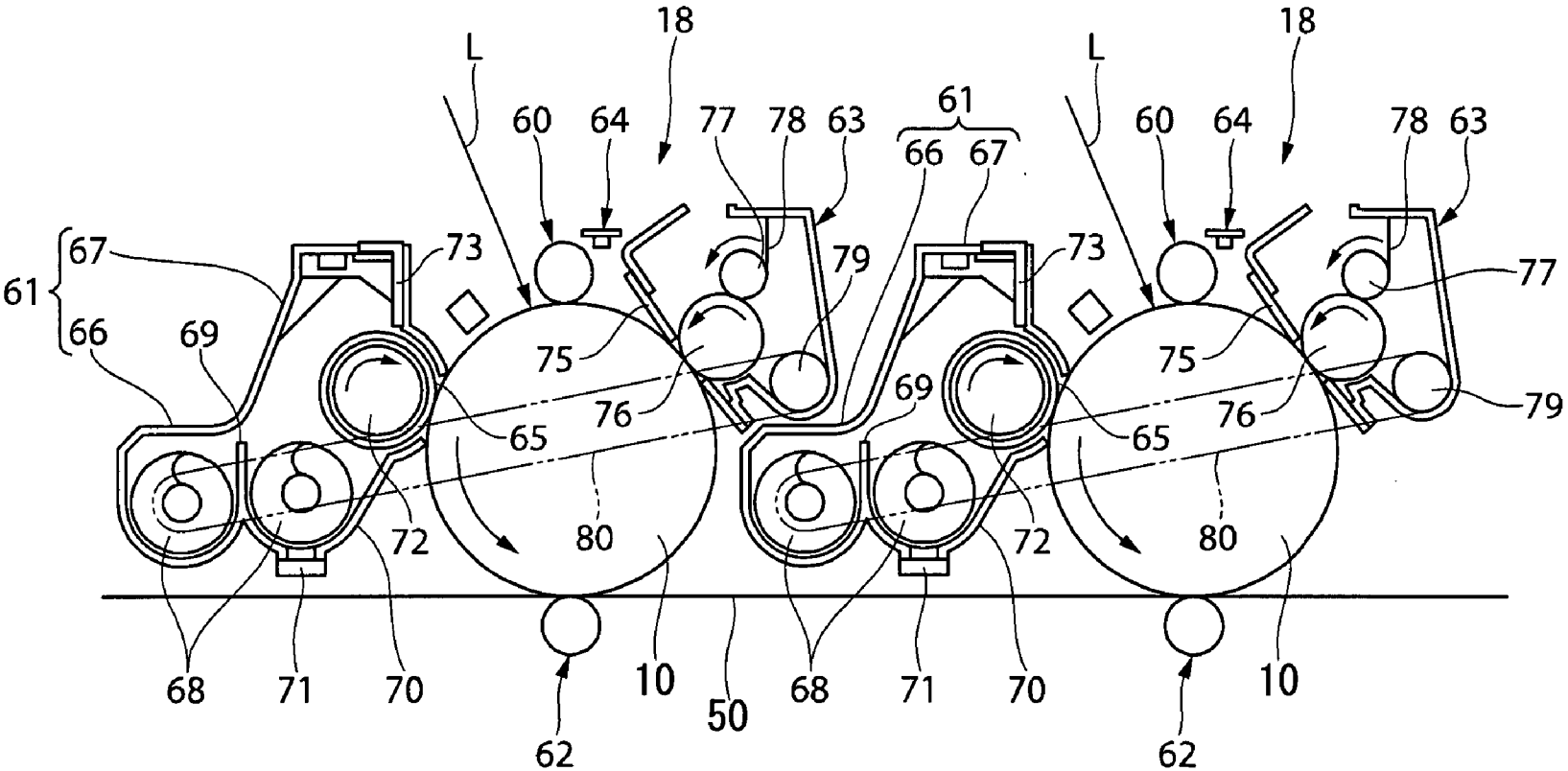
FIG. 6 is a partially enlarged schematic diagram of the image forming apparatus shown by FIG. 5.

Still another embodiment of the image forming process using the image forming apparatus will be illustrated with reference to FIG. 5. The image forming apparatus shown in FIG. 5 is a tandem color image forming apparatus which includes a copier main body 150, feeder table 200, scanner 300 and automatic document feeder (ADF) 400.

The copier main body 150 includes an endless-belt intermediate image-transfer member 50 at its center part. The intermediate image-transfer member 50 is spanned over three support rollers 14, 15 and 16 and is capable of rotating and moving in a clockwise direction in FIG. 5. An intermediate image-transfer member cleaner 17 is arranged in the vicinity of the second support roller 15. The intermediate image-transfer member cleaner 17 is capable of removing a residual toner from the intermediate image-transfer member 50 after image transfer. Above the intermediate image-transfer member 50 spanned between the first and second support rollers 14 and 15, yellow, cyan, magenta and black image forming devices 18 are arrayed in parallel in a moving direction of the intermediate image-transfer member 50 to thereby constitute a tandem image forming unit 120. A light irradiator 21 is arranged in the vicinity of the tandem image forming unit 120. A secondary image-transferer 22 faces the tandem image-developer 120 with the interposition of the intermediate image transfer member 50. The secondary image-transferer 22 comprises an endless belt serving as a secondary transfer belt 24 spanned over two rollers 23. The transfer sheet transported on the secondary transfer belt 24 is capable of being in contact with the intermediate image transfer member 50. An image-fixer 25 is arranged on the side of the secondary image-transferer 22. The image-fixer 25 comprises an endless image-fixing belt 26 and a pressure roller 27 pressed on the image-fixing belt 26.

The tandem image forming apparatus further includes a sheet reverser 28 in the vicinity of the secondary image-transferer 22 and the image-fixer 25. The sheet reverser 28 is capable of reversing the transfer sheet so as to form images on both sides of the transfer sheet.

A full-color image (color copy) is formed by using the tandem image forming apparatus in the following manner. Initially, a document is placed on a document platen 130 of the automatic document feeder (ADF) 400. Alternatively, the automatic document feeder 400 is opened, the document is placed on a contact glass 32 of the scanner 300, and the automatic document feeder 400 is closed to press the document.

At the push of a start switch (not shown), the document, if any, placed on the automatic document feeder 400 is transported onto the contact glass 32. When the document is initially placed on the contact glass 32, the scanner 300 is immediately driven to operate a first carriage 33 and a second carriage 34. Light is applied from a light source to the document by action of the first carriage 33, and reflected light from the document is further reflected toward the second carriage 34. The reflected light is further reflected by a mirror of the second carriage 34 and passes through an image-forming lens 35 into a read sensor 36 to thereby read the color document (color image) and to produce black, yellow, magenta and cyan image information.

Each of the black, yellow, magenta and cyan image information is transmitted to each of the image forming devices 18 (black, yellow, magenta and cyan image forming devices) in the tandem image forming apparatus to thereby form black, yellow, magenta and cyan toner images therein. More specifically with reference to FIG. 7, each of the image forming devices 18 (black, yellow, magenta and cyan image forming devices) in the tandem image forming apparatus has a photoconductor 10 (black photoconductor 10K, yellow photoconductor 10Y, magenta photoconductor 10M or cyan photoconductor 10C), an electrostatic charger 60, a light irradiator, a image-developer 61, a transfer charger 62, a photoconductor cleaner 63, and a charge-eliminator 64 and can form a monochrome image (black, yellow, magenta or cyan image) based on the color image information. The charger 60 serves to charge the photoconductor uniformly. The light irradiator applies light (L in FIG. 7) to the photoconductor color-imagewise based on each color image information to thereby form a latent electrostatic image corresponding to the color image. The image-developer 61 develops the latent electrostatic image with a color developer (black, yellow, magenta or cyan developer) to thereby form a visible image. The transfer charger 62 transfers the visible image to the intermediate image transfer member 50. The black image formed on the black photoconductor 10K, the yellow image formed on the yellow photoconductor 10Y, the magenta image formed on the magenta photoconductor 10M and the cyan image formed on the cyan photoconductor 10C are sequentially transferred (primary transfer) and superimposed onto the intermediate image transfer member 50 rotated and shifted by the support rollers 14, 15 and 16. Thus, a composite color image (transferred color image) is formed.

One of feeder rollers 142 of the feeder table 200 is selectively rotated, sheets are ejected from one of multiple feeder cassettes 144 in a paper bank 143 and are separated by a separation roller 145 one by one into a feeder path 146, are transported by a transport roller 147 into a feeder path 148 in the copier main body 150 and are bumped against a resist roller 49. Alternatively, a feeder roller 150 is rotated to eject sheets on a manual bypass tray 51, the sheets are separated one by one by a separation roller 52 into a manual bypass feeder path 53 and are bumped against the resist roller 49. The resist roller 49 is generally grounded but can be used under the application of a bias to remove paper dust of the sheets.

The resist roller 49 is rotated synchronously with the movement of the composite color image on the intermediate image-transfer member 50 to transport the sheet (recording paper) into between the intermediate image-transfer member 50 and the secondary image-transferer 22, and the composite color image is transferred onto the sheet by action of the secondary image-transferer 22 to thereby transfer the color image to the recording sheet. Separately, the intermediate image-transfer member cleaner 17 removes residual developers on the intermediate image-transfer member 50 after image transfer.

The sheet (recording sheet) bearing the transferred color image is transported by the secondary image-transferer 22 into the image-fixer 25, is applied with heat and pressure in the image-fixer 25 to fix the transferred color image. The sheet then changes its direction by action of a switch blade 55, is ejected by an ejecting roller 56 and is stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 onto the output tray 57.

In the image forming apparatus and process, the toner according to the present invention is employed, in which the toner exhibits the equivalent specific density to the prior non-magnetic toner containing carbon black, and the toner is easily exchanged in the apparatus in use without causing a necessity to adjust the controlling value of toner concentration sensor, accordingly, the image forming may be carried out without the concerns for human body and environment.

Present invention will be explained with reference to examples, which do not limit the scope of the present invention.

(Characterization Procedure)

The properties of the toner according to the present invention, the resultant images and the specific density of the toner were characterized and determined in the following manner.

<Determination of Image Density, Color Reproducibility, Volume-Average Particle Size, and Dielectric Loss>

(1) Image density was determined by means of X-Rite 938 in display system: DEN and response A, following to fixing the toner by an Image Forming Apparatus (imagio MF2230, produced by Ricoh Company, Limited) with a controlled deposition amount of 1.0 mg/cm$^2$ on a transfer sheet.

(2) Color reproducibility was determined by means of X-Rite 938 at the color-phase of image density 0.8 after the deposition in the controlled amount, with the condition of color space of L*a*b*, optical source of D50 and 2° of view angle.

(3) Volume-average particle size of toner was determined by Multi-Sizer IIe (Coulter Counter Co.) equipped with a tube of 100 μm aperture.

(4) Dielectric loss tangent (tan δ) was determined by measuring the capacitance and conductance of the sample toner at a frequency of 1 kHz by means of TR-10C Type Dielectric Loss Tangent Tester (Ando Electric Co.), following to pressing the sample toner at a pressure of 480 kgf/cm$^2$ and setting it in SE-70 Type Electrode for Solid (Ando Electric Co.).

<Determination of Original Concentration on OPC Surface>

The property was determined as the difference in the concentration with respect to the tape ($ID_g$) attached to a white paper, following to peeling off the toner that adheres on the background portion of latent image support that corresponds to blank copy, from the concentration with respect to the tape ($ID_0$), attached to a white paper, which does not bears a toner.

<Determination of Pores in the Mixture>

The cross-section of the mixture was observed by means of SEM, and the individual major axes of the pores were determined at the cross-section.

<Determination of Specific Density>

The specific density of toner was determined as follows, i.e. 1 gram of toner is pressed at 400 kgf/cm$^2$ for five minutes in a discal cavity having a diameter of 20 mm, then the discal toner is removed; the discal toner volume (V) is calculated from the diameter and height, measured at 10 minutes after releasing the pressure on the discal toner, and the discal toner mass (W) is measured; then the specific density is determined from the following Formula (2).

$$\text{Specific Density } (\rho_T) = W/V \qquad \text{Formula (2)}$$

EXAMPLE 1

46 parts by mass of polyester resin (all pass through 2 mm screen opening), 5 parts by mass of polyethylene wax, 40 parts by mass of MnFe ferrite (0.2 μm of number-average particle diameter, 0.2 Am$^2$/kg of saturation magnetization), 1 parts by mass of charge controlling agent, and 8 parts by mass of azodicarbonamide as a foaming agent having a volume-average particle diameter of 5 μm were pre-mixed in a Henshell mixer, then the resultant pre-mixture was kneaded by means of a biaxial kneader along with expanding the foaming agent to obtain a spongy mixture. In the resultant mixture, there existed pores of 0.2 to 20 μm at about 20% by volume. The mixture was processed through milling and classifying steps; thereby a toner was obtained having a volume-average particle diameter of 7.0 μm and a dielectric loss tangent (tan δ) of $10\times10^{-3}$. The specific density of the toner was 1.30 g/cm$^3$.

Then 0.6 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.40, the color reproducibility was a*=−0.1, b*=−0.5, and the quality was equivalent to the electrophotographic toner which contains carbon black as the colorant.

Further, the consumed amount of the toner as well as the carrier life after a running test were equivalent to those of the toner which contains carbon black as the colorant. Also the background concentration of OPC was 0.02.

EXAMPLE 2

31 parts by mass of polyester resin (all pass through 2 mm screen opening), 3 parts by mass of carnauba wax, 50 parts by mass of TiFe complex oxide (0.12 μm of number-average particle diameter, 0.5 Am$^2$/kg of saturation magnetization), 3 parts by mass of salicylate type metal salt, 12 parts by mass of azodicarbonamide as a foaming agent having a volume-average particle diameter of 5 μm, and 1 parts by mass of stearic acid were pre-mixed in a Henshell mixer, then the resultant pre-mixture was kneaded by means of a biaxial kneader along with expanding the foaming agent to obtain a spongy mixture. In the resultant mixture, there existed pores of 0.2 to 20 μm at about 30% by volume. The mixture was processed through milling and classifying steps; thereby a toner was obtained having a volume-average particle diameter of 9.0 μm and a dielectric loss tangent (tan δ) of $3\times10^{-3}$. The specific density of the toner was 1.27 g/cm$^3$.

Then 0.5 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.42, the color reproducibility was a*=−0.0, b*=−0.2, and the quality was equivalent to the electrophotographic toner which contains carbon black as the colorant.

Further, the consumed amount of the toner as well as the carrier life after a running test were equivalent to those of the toner which contains carbon black as the colorant. Also the background concentration of OPC was 0.0.

EXAMPLE 3

73 parts by mass of polyester resin (all pass through 2 mm screen opening), 5 parts by mass of polyethylene wax, 10 parts by mass of $Fe_2O_3$—$Mn_2O_3$ (0.25 μm of number-average particle diameter, 2.0 Am$^2$/kg of saturation magnetization), 1 parts by mass of charge controlling agent, and 2 parts by mass of azodicarbonamide as a foaming agent having a volume-average particle diameter of 5 μm were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 10% by volume. The mixture was processed through milling and classifying steps; thereby a toner was obtained having a volume-average particle diameter of 11.5 μm and a dielectric loss tangent (tan δ) of $4\times10^{-3}$. The specific density of the toner was 1.1 g/cm$^3$.

Then 0.4 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.35, the color reproducibility was a*=−0.1, b*=−0.3, and the quality was equivalent to the electrophotographic toner which contains carbon black as the colorant.

Further, the consumed amount of the toner as well as the carrier life after a running test were equivalent to those of the toner which contains carbon black as the colorant. Also the background concentration of OPC was 0.0.

EXAMPLE 4

78.5 parts by mass of styrene-acryl resin (all pass through 2 mm screen opening), 5 parts by mass of low-molecular weight polypropylene, 10 parts by mass of TiFe complex oxide (0.3 μm of number-average particle diameter, 3.0 $Am^2/kg$ of saturation magnetization), 1 parts by mass of charge controlling agent, 5 parts by mass of azodicarbonamide as a foaming agent having a volume-average particle diameter of 5 μm, and 0.5 parts by mass of urea were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 15% by volume. The mixture was processed through milling and classifying steps; thereby a toner was obtained having a volume-average particle diameter of 9.0 μm and a dielectric loss tangent (tan δ) of $3\times10^{-3}$. The specific density of the toner was 1.01 $g/cm^3$.

Then 0.9 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.42, the color reproducibility was a*=−0.2, b*=−0.3, and the quality was equivalent to the electrophotographic toner which contains carbon black as the colorant.

Further, the consumed amount of the toner as well as the carrier life after a running test were equivalent to those of the toner which contains carbon black as the colorant. Also the background concentration of OPC was 0.0.

EXAMPLE 5

58.5 parts by mass of polyester resin (all pass through 2 mm screen opening), 5 parts by mass of carnauba wax, 30 parts by mass of TiFe ferrite (0.15 μm of number-average particle diameter, 0.5 $Am^2/kg$ of saturation magnetization), 1 parts by mass of charge controlling agent, 5 parts by mass of azodicarbonamide as a foaming agent having a volume-average particle diameter of 5 μm, and 0.5 parts by mass of stearic acid were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 15% by volume. The mixture was processed through milling and classifying steps; thereby a toner was obtained having a volume-average particle diameter of 5.5 μm and a dielectric loss tangent (tan δ) of $13\times10^{-3}$. The specific density of the toner was 1.22 $g/cm^3$.

Then 0.6 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.42, the color reproducibility was a*=0.1, b*=0.0, and the quality was equivalent to the electrophotographic toner which contains carbon black as the colorant.

Further, the consumed amount of the toner as well as the carrier life after a running test were equivalent to those of the toner which contains carbon black as the colorant. Also the background concentration of OPC was 0.03.

EXAMPLE 6

43 parts by mass of polyester resin (all pass through 2 mm screen opening), 5 parts by mass of carnauba wax, 40 parts by mass of titanium oxide sintered body (0.05 μm of number-average particle diameter, 0.5 $Am^2/kg$ of saturation magnetization), 1 parts by mass of charge controlling agent, 10 parts by mass of azodicarbonamide as a foaming agent having a volume-average particle diameter of 5 μm, and 1 parts by mass of stearic acid were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 25% by volume. The mixture was processed through milling and classifying steps; thereby a toner was obtained having a volume-average particle diameter of 7.0 μm and a dielectric loss tangent (tan δ) of $10\times10^{-3}$. The specific density of the toner was 1.22 $g/cm^3$.

Then 0.6 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.45, the color reproducibility was a*=0.1, b*=0.0, and the quality was equivalent to the electrophotographic toner which contains carbon black as the colorant.

Further, the consumed amount of the toner as well as the carrier life after a running test were equivalent to those of the toner which contains carbon black as the colorant. Also the background concentration of OPC was 0.02.

EXAMPLE 7

26 parts by mass of polyester resin (all pass through 2 mm screen opening), 3 parts by mass of polyethylene wax, 55 parts by mass of TiFe ferrite (0.15 μm of number-average particle diameter, 0.5 $Am^2/kg$ of saturation magnetization), 1 parts by mass of charge controlling agent, 14 parts by mass of azodicarbonamide as a foaming agent having a volume-average particle diameter of 5 μm, and 1 parts by mass of stearic acid were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 35% by volume. The mixture was processed through milling and classifying steps; thereby a toner was obtained having a volume-average particle diameter of 7.0 μm and a dielectric loss tangent (tan δ) of $10\times10^{-3}$. The specific density of the toner was 1.25 $g/cm^3$.

Then 0.6 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.42, the color reproducibility was a*=0.3, b*=−0.6, and the quality was equivalent to the electrophotographic toner which contains carbon black as the colorant.

However, the carrier life after a running test were as short as about 60% of the toner which contains carbon black as the colorant. Also the background concentration of OPC was 0.03.

COMPARATIVE EXAMPLE 1

71 parts by mass of polyester resin (all pass through 2 mm screen opening), 5 parts by mass of polyethylene wax, 10 parts by mass of MnFe ferrite (0.2 μm of number-average particle diameter, 0.2 $Am^2/kg$ of saturation magnetization), 1 parts by mass of charge controlling agent, 12 parts by mass of azodicarbonamide as a foaming agent having a volume-average particle diameter of 5 μm, and 1 parts by mass of stearic acid were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 30% by volume. The mixture was processed through milling and classifying steps; thereby a toner was obtained having a volume-average particle diameter of 7.0 μm and a dielectric loss tangent (tan δ) of $12\times10^{-3}$. The specific density of the toner was 0.84 $g/cm^3$.

Then 0.6 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was as low as 1.20. Also the background concentration of OPC was 0.03.

COMPARATIVE EXAMPLE 2

35 parts by mass of polyester resin (all pass through 2 mm screen opening), 3 parts by mass of polyethylene wax, 50 parts by mass of MnFe ferrite (0.2 μm of number-average particle diameter, 0.2 $Am^2/kg$ of saturation magnetization), 1 parts by mass of charge controlling agent, 10 parts by mass of azodicarbonamide as a foaming agent having a volume-average particle diameter of 5 μm, and 1 parts by mass of stearic acid were pre-mixed in a Henshell mixer, then the resultant pre-mixture was kneaded by means of a biaxial kneader along with expanding the foaming agent to obtain a mixture. In the resultant mixture, there existed pores of 0.2 to 20 μm at about 25% by volume. The mixture was processed through milling and classifying steps; thereby a toner was obtained having a volume-average particle diameter of 7.0 μm and a dielectric loss tangent (tan δ) of $6\times10^{-3}$. The specific density of the toner was 1.37 $g/cm^3$.

Then 0.6 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was as high as 1.45, however, the consumed amount of the toner was as much as 1.2 times of the reference. Also the background concentration of OPC was 0.01.

COMPARATIVE EXAMPLE 3

84.0 parts by mass of styrene-acryl resin (all pass through 2 mm screen opening), 5 parts by mass of low-molecular weight polypropylene, 10 parts by mass of TiFe complex oxide (0.3 μm of number-average particle diameter, 3.0 $Am^2/kg$ of saturation magnetization), 1 parts by mass of charge controlling agent, 5 parts by mass of azodicarbonamide as a foaming agent having a volume-average particle diameter of 5 μm, and 0.5 parts by mass of urea were pre-mixed in a Henshell mixer, then the resultant pre-mixture was kneaded by means of a biaxial kneader along with expanding the foaming agent to obtain a mixture. By the way, in the above-noted melting and kneading step, a degassing apparatus was employed so that the mixture did not contain pores. The mixture was processed through the milling and classifying step; thereby a toner was obtained having a volume-average particle diameter of 9.0 μm and a dielectric loss tangent (tan δ) of $3\times10^{-3}$. The specific density of the toner was 1.25 $g/cm^3$.

Then 0.9 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.43, the color reproducibility was a*=−0.2, b*=−0.3, and the quality was equivalent to the electrophotographic toner which contains carbon black as the colorant.

Further, the consumed amount of the toner was equivalent to that of the toner which contains carbon black as the colorant. However, the background concentration of OPC was 0.15, and the consumed amount of the toner was as much as 1.3 times of the reference.

COMPARATIVE EXAMPLE 4

31 parts by mass of polyester resin (all pass through 2 mm screen opening), 3 parts by mass of carnauba wax, 50 parts by mass of TiFe complex oxide (0.12 μm of number-average particle diameter, 0.5 $Am^2/kg$ of saturation magnetization), 3 parts by mass of salicylate type metal salt, 12 parts by mass of azodicarbonamide as a foaming agent having a volume-average particle diameter of 12 μm, and 1 parts by mass of stearic acid were pre-mixed in a Henshell mixer, then the resultant pre-mixture was kneaded by means of a biaxial kneader along with expanding the foaming agent to obtain a spongy mixture. In the resultant mixture, there existed pores at about 30% by volume, and the variation in the pore sizes was significant. The mixture was processed through a milling and classifying step; thereby a toner was obtained having a volume-average particle diameter of 9.0 μm and a dielectric loss tangent (tan δ) of $3\times10^{-3}$. The specific density of the toner was 1.27 $g/cm^3$.

Then 0.5 parts by mass of hydrophobic silica was added and mixed to 100 parts by mass of the resultant toner to prepare an electrophotographic toner. The electrophotographic toner was supplied to the Image Forming Apparatus (imagio MF2230, by Ricoh Company, Limited) and images were formed with the result that the image concentration was 1.42, the color reproducibility was a*=−0.0, b*=−0.2, and the quality was equivalent to the electrophotographic toner which contains carbon black as the colorant. Also the background concentration of OPC was 0.0.

However, the background concentration of OPC turned into 0.15 after carrying out the running of 10,000 sheets, also the consumed amount of the toner was as much as 1.2 times of the reference. Further, a degree of roughness was recognized in the images after the running of 10,000 sheets.

The toner according to the present invention may be utilized for copier of direct or indirect electrophotography developing type, laser printer, plain paper fax and the like, and may be broadly applied for the developer containing the toner, image forming process which employ the developer, image forming process which loads the toner, and process cartridge which sustains the developer.

What is claimed is:

1. A toner formed from a toner raw composition comprising a foaming agent, a binder resin and a colorant, wherein:

the colorant comprises a black metal compound;

the foaming agent has a volume-average particle diameter of from 2 μm to 50 μm;

the toner raw composition turns into a porous mixture as the foaming agent expands during melting and kneading of the toner raw composition;

after milling and classifying the porous mixture, the toner is obtained having a specific density of from 1.0 g/cm$^3$ to 1.3 g/cm$^3$; and the specific density is determined as follows:

1 gram of toner is pressed at 400 kgf/cm$^2$ for five minutes in a discal cavity having a diameter of 20 mm, then the discal toner is removed;

discal toner volume (V) is calculated from diameter and height, measured at 10 minutes after releasing pressure on the discal toner, and the discal toner mass (W) is measured; and then the specific density is determined from a formula;

$$\text{Specific Density } (\rho_T) = W/V.$$

2. A toner according to claim 1, wherein the foaming agent is present in the toner raw composition in an amount of from 2% by weight to 20% by weight.

3. A toner according to claim 1, wherein porous mixture has a pore size of from 0.2 μm to 20 μm.

4. A toner according to claim 3, wherein the porous mixture has a total volume of the pores of from 10% by volume to 30% by volume.

5. A toner according to claim 1, wherein the black metal compound is present in the toner raw composition in an amount of from 10% by weight to 50% by weight.

6. A toner according to claim 1, wherein the black metal compound has a saturation magnetization of 10 Am$^2$/kg or less.

7. A toner according to claim 1, wherein the black metal compound has a number-average particle diameter of from 0.02 μm to 0.3 μm.

8. A toner according to claim 1, wherein the binder resin exhibits an average particle size of 2 mm or less.

9. A toner according to claim 1, wherein the toner exhibits a dielectric loss of $3\times10^3$ to $15\times10^3$.

10. A process for producing a toner, comprising:

melting and kneading toner a toner raw composition, which comprises a foaming agent, a binder resin and a black metal compound colorant, the foaming agent expanding to form a porous mixture from the toner raw composition; and milling and classifying the porous mixture to obtain a toner having a specific density of from 1.0 g/cm$^3$ to 1.3 g/cm$^3$.

11. A process for producing a toner according to claim 10, wherein the porous mixture obtained by melting and kneading has a pore size of from 0.2 μm to 20 μm.

12. A process for producing a toner according to claim 11, wherein pores are present in the porous mixture in an amount from 10% by volume to 30% by volume.

13. A developer comprising a toner that has a specific density of 1.0 g/cm$^3$ to 1.3 g/cm$^3$, wherein:

the toner is formed from a toner raw composition comprising a foaming agent, a binder resin and a colorant;

the colorant comprises a black metal compound;

the foaming agent has a volume-average particle diameter of from 2 μm to 50 μm;

the toner raw composition turns into a porous mixture as the foaming agent expands during melting and kneading of the toner raw composition.

14. A developer according to claim 13, wherein the developer is one a single-component and a double-component developer.

15. A container containing a toner, comprising a toner and a bottle, wherein:

the toner is formed from a toner raw composition comprising a foaming agent, a binder resin and a colorant;

the colorant comprises a black metal compound;

the foaming agent has a volume-average particle diameter of from 2 μm to 50 μm, the toner raw composition turns into a porous mixture as the foaming agent expands during melting and kneading of the toner raw composition, and after milling, and classifying the porous mixture, the toner is obtained having a specific density of from 1.0 g/cm$^3$ to 1.3 g/cm$^3$.

16. A process cartridge comprising a latent electrostatic image bearing member, and a developing unit configured to develop an electrostatic image into a visible image using, wherein:

the toner is formed from a toner raw composition comprising a foaming agent, a binder resin and a colorants;

the colorant comprises a black metal compound;

the foaming agent has a volume-average particle diameter of from 2 μm to 50 μm, the toner raw composition turns into a porous mixture as the foaming agent expands during melting and kneading of the toner raw composition; and after milling and classifying the porous mixture, the toner is obtained having a specific density of 1.0 μm$^3$ to 1.3 g/cm$^3$.

17. An image forming apparatus, comprising:

a latent electrostatic image bearing member;

a forming unit configured to form an electrostatic latent image on the latent electrostatic image bearing member;

a developing unit configured to develop an electrostatic latent image using a toner to form a visible image;

a transferring unit configured to transfer the visible image to a recording medium; and a fixing unit configured to fixing the transferred image on the recording medium;

wherein:

the toner is formed from a toner raw composition comprising a foaming agent, a binder resin and a colorant;

the colorant comprises a black metal compound;

the foaming agent has a volume-average particle diameter of from 2 μm to 50 μm;

the raw composition turns into a porous mixture as the foaming agent expands during melting and kneading of the toner raw composition; and after milling and classifying the porous mixture, the toner is obtained having a specific density of from 1.0 g/cm$^3$ to 1.3 g/cm$^3$.

18. An image forming process, comprising:

forming an electrostatic latent image on a latent electrostatic image bearing member;

developing the latent electrostatic image using a toner to form a visible image;

transferring the visible image to a recording; and fixing the transferred image on the recording medium;

wherein:

the toner is formed from a toner raw composition comprising a foaming agent, a binder resin and a colorant;

the colorant comprises a black metal compound, the foaming agent has a volume-average particle diameter of from 2 μm to 50 μm;

the toner raw composition turns into a porous mixture as the foaming agent expands during melting and kneading of the toner raw composition; and after milling and classifying the porous mixture, the toner is obtained having a specific density of 1.0 g/cm$^3$ to 1.3 g/cm$^3$.

* * * * *

UNITED STATES PATENT AND TRADEMARK OFFICE

CERTIFICATE OF CORRECTION

PATENT NO. : 7,250,240 B2
APPLICATION NO. : 10/863248
DATED : July 31, 2007
INVENTOR(S) : Hachiroh Tosaka et al.

It is certified that error appears in the above-identified patent and that said Letters Patent is hereby corrected as shown below:

First page, Title, (54), "TONER, DEVELOPER, CONTAINER CONTAINING TONER, PROCESS, CARTRIDGE, IMAGE FORMING APPARATUS AND PROCESS"

should read -- TONER, DEVELOPER, CONTAINER CONTAINING TONER, PROCESS CARTRIDGE, IMAGE FORMING APPARATUS AND PROCESS --.

Signed and Sealed this

Eighteenth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 7,250,240 B2
APPLICATION NO. : 10/863248
DATED : July 31, 2007
INVENTOR(S) : Hachiroh Tosaka et al.

It is certified that error appears in the above-identified patent and that said Letters Patent is hereby corrected as shown below:

First page, Title, (54) and Column 1, lines 1-4, "TONER, DEVELOPER, CONTAINER CONTAINING TONER, PROCESS, CARTRIDGE, IMAGE FORMING APPARATUS AND PROCESS"

should read -- TONER, DEVELOPER, CONTAINER CONTAINING TONER, PROCESS CARTRIDGE, IMAGE FORMING APPARATUS AND PROCESS --.

This certificate supersedes the Certificate of Correction issued March 18, 2008.

Signed and Sealed this

Fifteenth Day of April, 2008

JON W. DUDAS
*Director of the United States Patent and Trademark Office*